US005887710A

United States Patent [19]

London et al.

[11] Patent Number: 5,887,710

[45] Date of Patent: Mar. 30, 1999

[54] GARMENT BAG AND HANGER SUPPORT

[75] Inventors: Wallace London; James S. Deutschendorf, both of Owings Mills, Md.

[73] Assignee: Clemco Products, Inc., Baltimore, Md.

[21] Appl. No.: 806,535

[22] Filed: Feb. 24, 1997

[51] Int. Cl.[6] ..... A45C 3/00; A45C 5/12; B65D 85/18

[52] U.S. Cl. ..... 206/289; 206/287; 206/291; 211/124

[58] Field of Search ..... 206/279, 287, 206/289, 291, 285; 211/124, 87.01

[56] References Cited

U.S. PATENT DOCUMENTS

| | | | |
|---|---|---|---|
| 1,654,751 | 1/1928 | Oishei | 211/87.01 X |
| 2,068,451 | 1/1937 | Elmore | 211/124 |
| 2,215,695 | 9/1940 | Ginsberg | 206/279 |
| 2,671,706 | 3/1954 | Greengold | 206/287 X |
| 3,566,456 | 3/1971 | London | 206/285 X |
| 4,034,866 | 7/1977 | Beckwith | 206/279 |
| 4,252,220 | 2/1981 | London et al. | 206/285 X |
| 4,363,388 | 12/1982 | London et al. | 206/285 X |
| 4,438,844 | 3/1984 | Kesselman | 206/289 X |
| 4,618,058 | 10/1986 | Gregg et al. | 206/287 X |
| 4,640,414 | 2/1987 | Mobley et al. | 206/291 X |
| 4,732,270 | 3/1988 | Myers et al. | 206/289 |
| 4,753,342 | 6/1988 | Pulichino, Jr. et al. | 206/291 |
| 4,769,878 | 9/1988 | Liao | 206/279 X |
| 4,798,289 | 1/1989 | Mobley | 206/285 X |
| 4,850,562 | 7/1989 | Mazzanti | 206/291 X |
| 4,852,845 | 8/1989 | Lener | 211/124 X |
| 4,858,870 | 8/1989 | Mazzanti | 211/124 X |
| 4,880,113 | 11/1989 | Mobley | 206/285 X |
| 5,014,847 | 5/1991 | Droguet | 206/279 |
| 5,048,785 | 9/1991 | Shaw et al. | 206/291 X |
| 5,099,989 | 3/1992 | Goodin et al. | 206/286 |
| 5,400,900 | 3/1995 | Myers et al. | 206/289 |
| 5,531,335 | 7/1996 | Chen | 206/291 X |
| 5,590,765 | 1/1997 | London | 206/289 |

*Primary Examiner*—Sue A. Weaver
*Attorney, Agent, or Firm*—Gary M. Nath; Harold L. Novick; Nath & Associates

[57] ABSTRACT

A garment bag is provided having a hanger support attached to the upper wall thereof, and having upper and lower clamp jaws with a connecting structure between them permitting both rotational and translational movement. A mount structure connects the upper clamp jaw to the upper wall of the garment bag so that it is inclined upwardly from adjacent the rear wall to adjacent the front wall of the garment bag. A limiting pin holds the lower clamp jaw approximately horizontally in the release position. The clamp jaws are in the form of facing channels, and have resilient blocks having a durometer of from approximately 50 to approximately 60 in and extending from them. The resilient blocks may be mounted for transverse movement in the channels, and may be spring urged outwardly as by plural, linearly spaced coil springs, and are deeper than is conventional. The hanger support is able to securely clamp and hold both plastic hangers and wire hangers.

41 Claims, 4 Drawing Sheets

GARMENT BAG AND HANGER SUPPORT

BACKGROUND OF THE INVENTION

The present invention relates to a garment bag having a hanger support mounted in the garment bag, the hanger support being generally of the type including a pair of jaws which can be moved between an open position to receive the hooks of garment hangers and a closed position in which the hooks of the garment hangers are clamped between the jaws.

Hanger supports having pivoted clamp jaws and a latching device in a garment bag are disclosed in many prior patent, including U.S. Pat. Nos. 3,566,456, 4,252,220, 4,363,388, and 5,590,765. U.S. Pat. No. 4,363,888 discloses a garment bag having mounted to the top wall a hanger clamp which comprises a pair of jaws pivotally connected adjacent their rear ends, near the back of the garment bag, the lower jaw being capable of pivoting downwardly so as to move to a release position in which the hooks of hangers may be inserted and withdrawn. The hanger support has an actuating lever which is pivotally connected to the lower clamp jaw, a wire loop being pivotally connected to the actuating lever and engaging, in the closed position of the clamp jaws, an upper surface of the upper clamp jaw. In closed position, the clamp jaws of the hanger support are substantially parallel to each other and to the top wall of the garment bag. The clamp jaws are made of two linearly extending channels in facing relationship, in which are placed resilient rubber blocks having a depth greater than the depth of the channels.

U.S. Pat. No. 5,590,765 discloses a structure similar to that in U.S. Pat. No. 4,363,388, but in addition, includes a latching device which comprises a housing having a front plate which is outwardly of the ends of the clamp jaws, adjacent the front wall of the garment bag, being remote from a pivot pin which pivotally connects the two clamp jaws.

U.S. Pat. No. 4,798,289 and U.S. Pat. No. 4,880,113 disclose a garment hanger clamp construction in which a C-shaped frame provides a lower clamp jaw which is horizontal, and has an upper clamp jaw pivotally connected to it for movement between release and clamp positions. The upper jaw is carried by a lever pivoted to the C-shaped frame and is moved by a lever, which in the closed position, lies in front of the clamp jaws. The clamp jaws include pads which are flexible and resilient, and contain transverse holes of substantial size through them. The hanger supports in these patents are intended to clamp and support both wire hangers and plastic hangers due to the above noted construction of the resilient gripping pads.

U.S. Pat. No. 4,618,058 discloses a similar construction to that shown in U.S. Pat. Nos. 4,798,289 and 4,880,113, but two such garment hanger clamps are provided, one for wire hangers and one for plastic hangers, which have hooks of larger diameter.

In the above patents, it is necessary to provide a relatively large, C-shaped frame which carries a lower resilient pad and to which a jaw member carrying the upper resilient pad is pivoted, thereby being more expensive because of the large number of parts. If such parts are made of plastic material, they are more liable to breaking; were they to be made of metal for strength, the costs would be substantially increased.

U.S. Pat. No. 5,099,989 discloses a garment bag hanger support in which a frame supports a lower jaw having a pair of laterally spaced soft rubber cushions, above which are a pair of platens which are moved by a cover plate connected to the platens by a bail. The construction disclosed in this patent requires the additional element of a C-shaped mounting frame; it is therefore more expensive. It is made of plastic, and if it were to be made of metal, would be more expensive.

SUMMARY OF THE INVENTION

The present invention provides a garment bag with a hanger support having a clamp with upper and lower jaws which are movable between clamping and release positions; the upper jaw of the clamp is secured to the upper wall of the garment bag in an upwardly inclined position, from rear to front of the garment bag. A connecting structure connects the lower jaw of the clamp to the upper jaw for both pivotal and translational movement. The lower clamp jaw is substantially horizontal when it is in the release position, due to a limiting pin which limits the movement of the lower jaw relative to the upper jaw.

The hanger support is constructed of linearly extending and facing channels, preferably of metal, which have resilient blocks in and extending laterally from them to engage the hooks of hangers. These resilient blocks may be held in place by dimples in one or both side walls of each clamp jaw or they may be able to move within the clamp jaw, with one or more springs urging the resilient blocks towards each other to effect a tighter clamping action.

In order to assist in the holding of plastic hangers of relatively large diameter material, as well as smaller diameter wire hangers, there is provided the above noted springs acting on the resilient blocks, the utilization of resilient blocks having a durometer of from 50 to 60, preferably 55, the above noted connection of the two jaws also enabling a plastic hanger of large diameter material to be received between them, particularly adjacent the connecting structure which connects the two clamp jaws together.

Among the objects of the present invention are to provide a garment bag with a garment hanger support which is capable of accepting and firmly holding hangers made of both small diameter material and large diameter material.

Another object of the present invention is to provide a garment bag with a garment hanger support which is made of strong, long lasting components, and of minimal parts.

Still another object of the present invention is to provide a garment bag with a garment hanger support having upper and lower clamp jaws, wherein the lower clamp jaw is maintained in a substantially level position in the release position of the garment hanger support.

These and other objects and many of the attendant advantages of the present invention will be readily understood from the following specification and claims, and by reference to the appended drawings.

DESCRIPTION OF THE PREFERRED EMBODIMENTS

Figure 1:
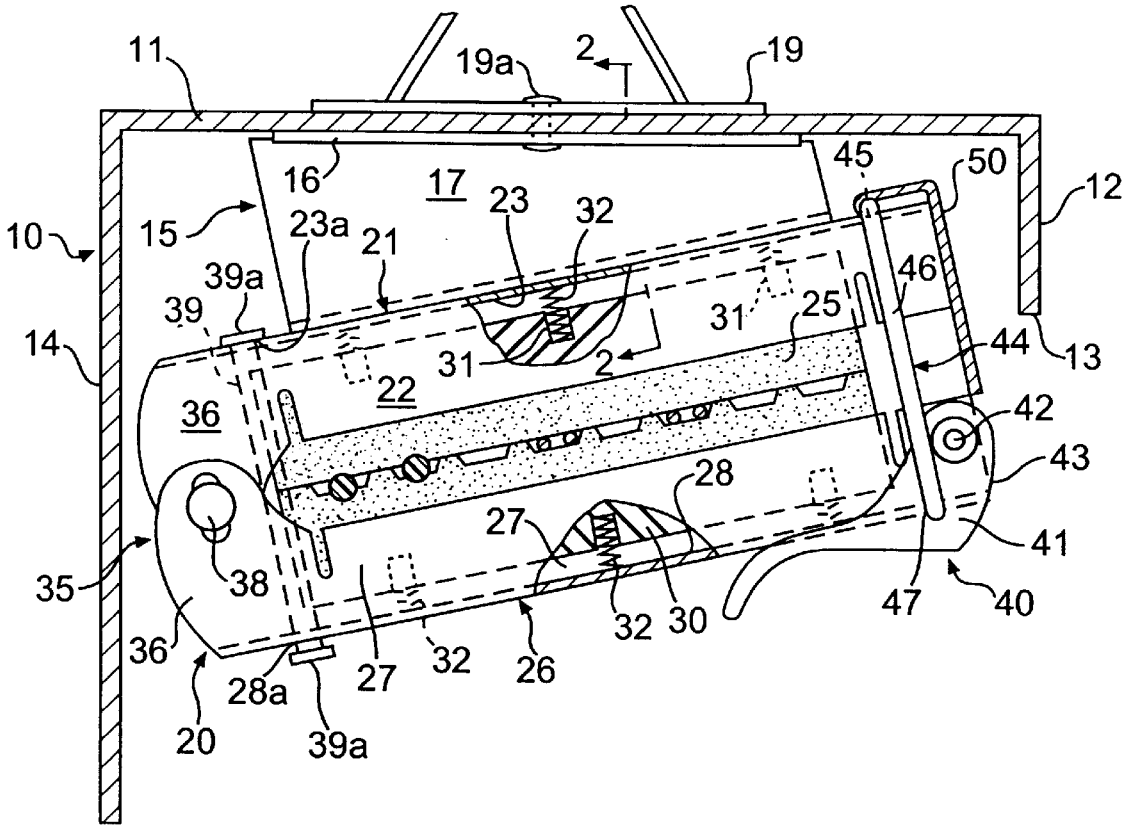
FIG. 1 is an elevational view, with parts in section and broken away, of a garment bag having a hanger support therein in accordance with the present invention.
Figure 2:
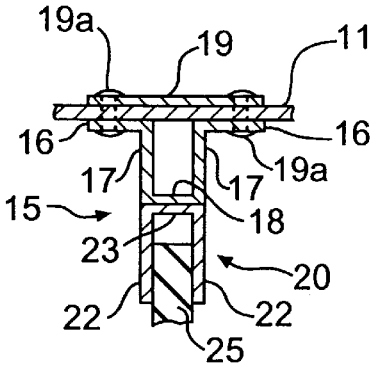
FIG. 2 is a cross-sectional view, taken on the line 2—2 of FIG. 1.

Referring now to the drawings wherein like or corresponding reference numerals are used for like or corresponding parts throughout the several views, there is shown in FIG. 1 a garment bag 10 having an upper wall 11, front wall 12 with an opening 13 therein to permit the introduction and removal of garment hangers, and a rear wall 14. Within the garment bag 10 and connected to the upper wall 11 is a mount structure or bracket 15 which, as shown in FIG. 2, comprises laterally extending flanges 16 which are beneath and in engagement with the upper wall 11. Mount structure or bracket 15 also includes a pair of side walls 17 which as shown are parallel, and at their bottoms are connected with the bottom wall 18. The bottom wall 18 has secured to it, as by welding, the transverse wall 23 of an upper clamp jaw 21, of a hanger support 20, as described below. A plate 19 is on the upper surface of the upper wall 11, opposite the flanges 16 and one or more fasteners 19*a* pass through the upper wall 11, plate 19 and flanges 16 to securely hold the mount structure or bracket 15 to the upper wall 11 of garment bag 10.

As shown in FIG. 1, the sidewalls 17 have a relatively large depth adjacent the rear wall 14, and decrease to a smaller depth towards the front wall 12. This construction causes the upper clamp jaw 21 to be angularly related to the upper wall 11 of garment bag 10, being inclined upwardly from adjacent rear wall 14 to adjacent front wall 12.

The upper clamp jaw 21 forms a part of the hanger support 20, and as shown in FIG. 2, is of channel shape, having side walls 22 which are generally perpendicular to the transverse wall 23. The hanger support 20 includes in addition to upper clamp jaw 21, a lower clamp jaw 26 which also is a channel, having side walls 27 and transverse wall 28. The upper clamp jaw 21 has partially therein it a resilient block 25 and the lower clamp jaw 26 has partially therein a resilient block 30. Each of the resilient blocks 25 and 30 has a greater depth than the respective upper clamp jaws 21 and 26 in which it is located.

Figure 4:
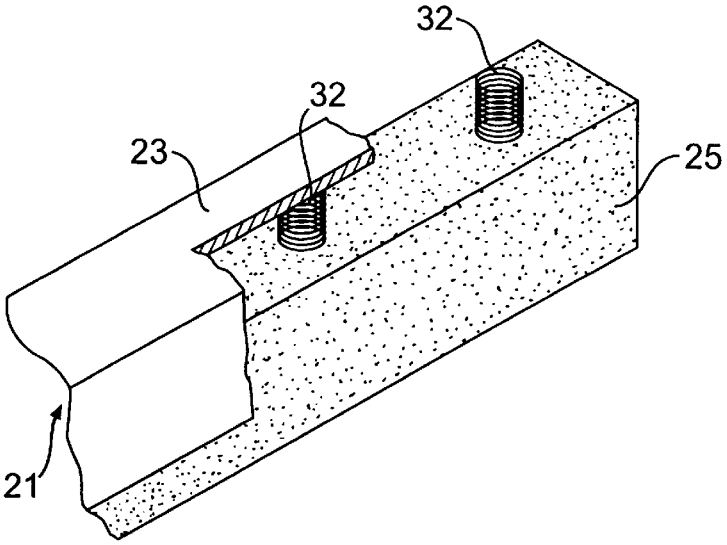
FIG. 4 is a perspective view, with parts removed and in section, of a portion of the hanger support shown in FIG. 1.

The resilient blocks 25 and 30 are preferably of a rubber or rubberlike composition having a durometer of between 50 and 60, preferably having a durometer of 55. Each of the resilient blocks 25 and 30 is dimensioned, relative to the clamp jaw 21 and 26 in which it is located, to permit transverse movement thereof towards and away from the transverse wall 23, 28. As shown in FIG. 1, each resilient block has a plurality of recesses 31 therein, and placed in each of the recesses is a spring 32, which is preferably a coil spring, as shown. The coil springs 32 are spaced linearly along the respective resilient blocks 25 and 30, and engage the transverse walls 23 and 28 of the clamp jaws 21 and 26. FIG. 4 shows spaced springs 32 in block 25 engaging transverse wall 23. Due to this construction, the various springs 32 urge the resilient blocks 25 and 30 outwardly of their respective upper and lower clamp jaws 21 and 26.

Figure 1A:
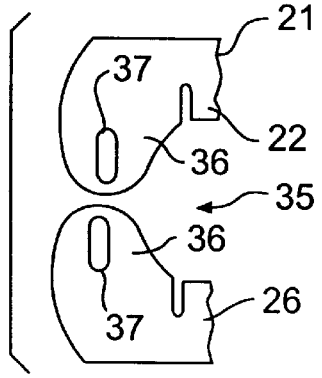
FIG. 1A is an exploded elevational view, with parts removed, of a portion of the hanger support shown in FIG. 1.
Figure 3:
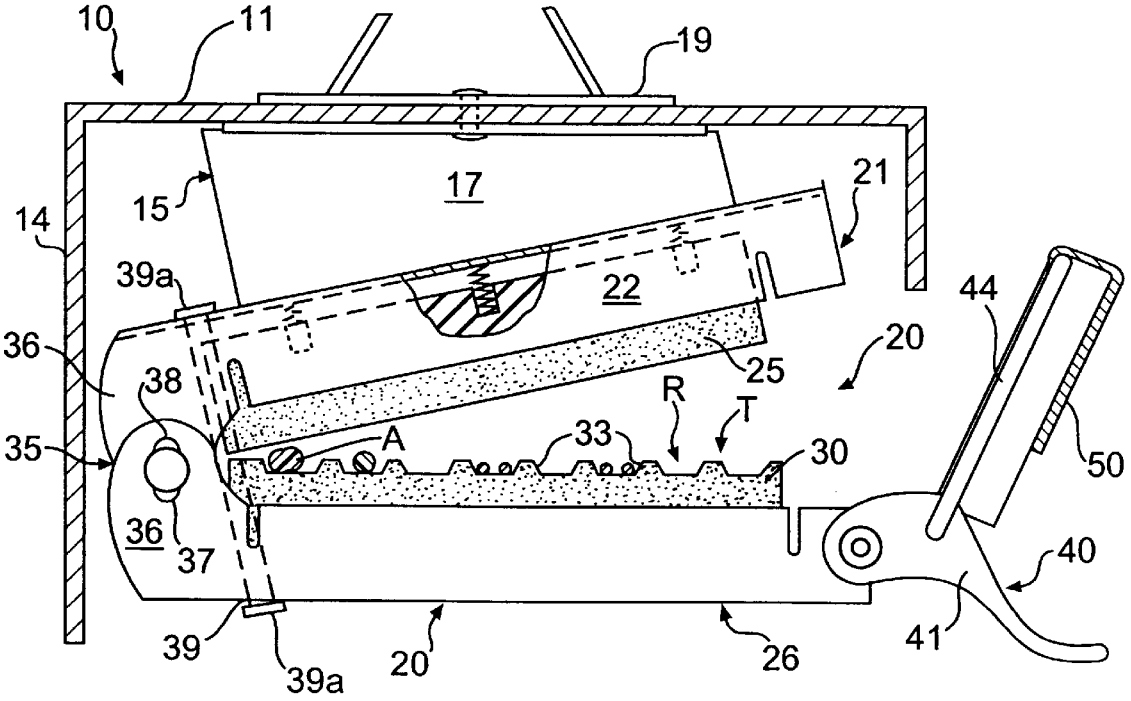
FIG. 3 is a view similar to FIG. 1, showing the hanger support in open position.

At the rear of the hanger support 20, which is adjacent rear wall 14 of garment bag 10, there is provided a structure 35 for movably connecting the clamp jaws 21 and 26. The connecting structure 35 includes ears 36 extending from the clamp jaws 21 and 26 towards each other, the ears 36 having openings 37 (see FIG. 1A) which are preferably elongate, and extend generally transversely of the transverse walls 23 and 28 of the respective clamp jaws 21 and 26 and of the length of clamp jaws 21 and 26, respectively. Passing through the elongate openings 37 in the ears 36 is a pivot pin 38. The ears 36 of only one of the clamp jaws 21, 26 may be provided with such openings 37, and the openings 37 may be other than elongate. The connecting structure 35 thus permits both rotational and movement (see FIG. 3, arrow R) of the lower clamp jaw 26 relative to the upper clamp jaw 21 and translational movement of lower clamp jaw 26 transverse to upper clamp jaw 21 (FIG. 3, arrow T), thereby providing a greater spacing between the resilient blocks 25 and 30, as shown in FIG. 3.

A limiting pin 39 extends through oversize openings 23*a* and 28*a* in the transverse walls 23 and 28 which are near and just forwardly of the connecting structure 35. The limiting pin 39 has heads 39*a* which engage, respectively, the upper and lower surfaces of the transverse walls 23 and 28. Thus, as shown in FIG. 3, which is of the hanger support 20 in the release position, the limiting pin 39 can move slightly along clamp jaws 21 and 26, and limits the extent of movement of the lower clamp jaw 26 relative to the upper clamp jaw 21, so that, as shown, the lower clamp jaw 26 is held substantially horizontal.

Referring again to FIG. 1, there is shown at the front end of the hanger support 20 a latching device 40, which is preferably of known construction. Latching device 40 comprises a lever 41 which has extending from it a pair of ears 43 which are outwardly of the side walls 27 of lower clamp jaw 26. Lever 41 is pivotally connected by a pin 42 at the forward end of lower clamp jaw 26. There is pivotally connected to the lever 41 a link 44 which is preferably in the form of a wire loop having a transverse upper portion 45, laterally spaced longitudinal portions 46 and pivot portions 47. The upper portion 45 of link 44, in the clamped or closed position of hanger support 20 as shown in FIG. 1, extends above and engages the upper surface of the transverse wall 23 of upper clamp jaw 21. The longitudinal portions 46 extend outwardly of the side walls 22 and 27 of the clamp jaws 21 and 26, and also are outwardly of the ears 43 of lever 41. The lower ends of the longitudinal portions 46 are inwardly directed pivot portions 47 which extend into openings in the lever 41. A front plate 50 is provided, and is connected to the loop 44, the front plate 50 passing in front of the forward ends of the clamp jaws 21 and 26. The construction of the latching device 40, including the lever 41, link 44 and cover plate 50, is substantially as shown in London U.S. Pat. No. 5,590,765, which is incorporated herein by reference.

The latching device 40 is shown in FIG. 1 in the position in which it holds the hanger support 20 in the clamping position thereof, in which hangers are clamped and securely held between the resilient blocks 25 and 30. In FIG. 3, the lever 41 has been moved to release the latching device 40, so that the lower clamp jaw 26 has been permitted to rotate and translate relative to inclined upper clamp jaw 21. The limiting pin 39 limits the movement of lower clamp jaw 26, so that it is substantially horizontal.

To provide for a combination of larger diameter plastic hangers and smaller diameter wire hangers, in addition to providing the pivotal and translational connection 35 for the upper and lower clamp jaws 21 and 26, and in addition to providing the resilient blocks 25 and 30 of the noted durometer of approximately 50–60, the resilient block 25 extends downwardly beyond the lower edge of the side walls 22 of upper clamp jaw 21. The resilient block 25 is relatively deep, having a depth of at least about 23/32 inch and extending well beyond the lower edge of the side walls 22. Further, the resilient block 30 in lower clamp jaw 26 is of the durometer noted and has a depth at the front thereof, adjacent latching device 40, of approximately 11/16 inch, and having at the rear thereof adjacent the connecting structure 35 a depth of approximately 9/16 inch. The upper surface of the resilient block 30 is preferably provided with transverse ribs 33. The ribs resist accidental dislodging of the hooks of garment hangers, to thereby avoid dropping of a garment hanger and the garment supported on it.

As shown in FIG. 3, a plastic garment hanger A may be readily positioned at the very rear of the hanger support 20, since the space between the resilient blocks 25 and 30 adjacent the connecting structure 35 is enabled to be relatively wide due to the fact that there is both a rotational and translational movement of the lower clamp jaw 26 relative to the upper clamp jaw 21 as permitted by openings 37, 23*a* and 28*a*. Consequently, the construction herein disclosed enables the placement and firm holding of both plastic and wire hangers, without predetermined positioning of them.

Figure 5:
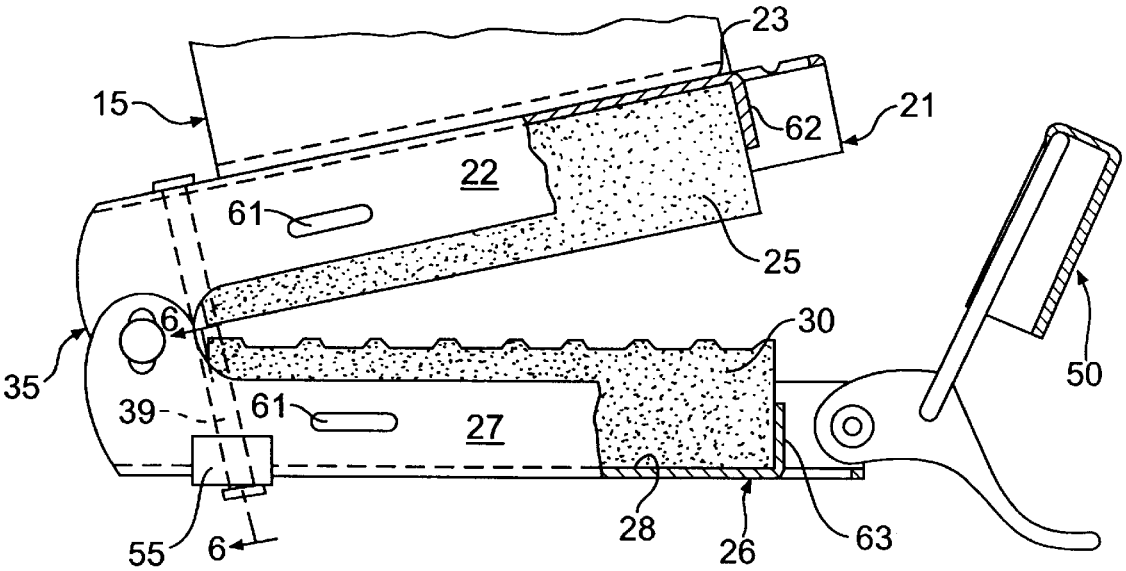
FIG. 5 is a cross-sectional view with parts removed and in section of an alternate embodiment of a hanger support for a garment bag.
Figure 6:
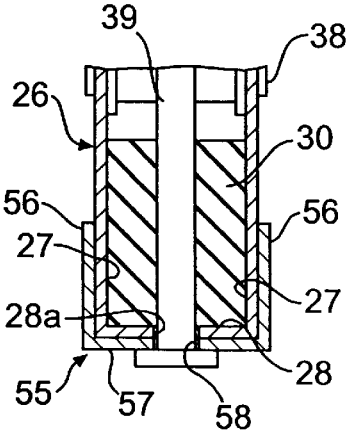
FIG. 6 is a cross-sectional view, taken on the line 6—6 of FIG. 5.

Referring now to FIG. 5, an alternate embodiment is shown. Mount structure 15 is shown broken away and supporting the hanger support 20 in the same inclined position as in FIG. 1 by being joined to transverse wall 23 of upper clamp jaw 21. The connecting structure 35 is substantially the same as that shown in FIG. 1, connecting the lower clamp jaw 26 to upper clamp jaw 21 for pivotal and translational movement. There may also be seen the limiting pin 39, which passes through a generally U-shaped stirrup 55 having flanges 56 which are outwardly of the side walls 27 of lower clamp jaw 26 and having a plate 57 below the transverse wall 28, as shown in FIG. 6. The stirrup 55 has an opening 58 through the plate 57 thereof which is larger than the shank of the limiting pin 39 so as to permit movement of stirrup 55 relative to the limiting pin 39. This movement is limited by the side walls 56 of stirrup 55 which are closely adjacent the side walls 27 of lower clamp jaw 26. In FIG. 6, there may be seen the limiting pin 39 and pivot pin 38, and the oversize opening 28*a*.

The side walls 22 and 27 of clamp jaws 21 and 26 are provided with indentations 61 to secure the rubber blocks 25 and 30 in place within them. In addition, upper clamp jaw 21 has a downwardly extending flange 62 which is at the front end of the resilient block 25. The limiting pin 39 is in a groove extending in the rear faces of the resilient blocks 25 and 30, in the manner shown in London 4,363,388. A similar flange 63 will be seen engaging the front end of the resilient block 30.

Figure 7:
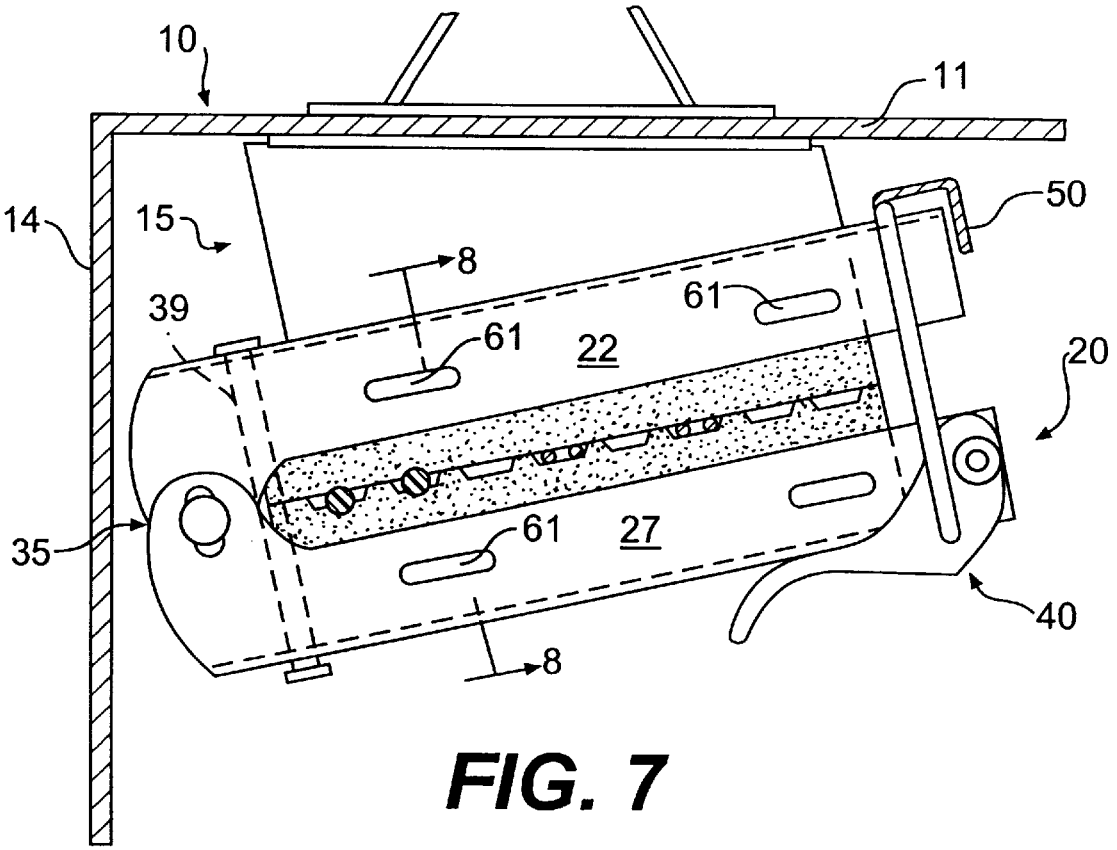
FIG. 7 is a view of a garment bag and hanger support as in FIG. 5, showing the hanger support in closed position.
Figure 8:
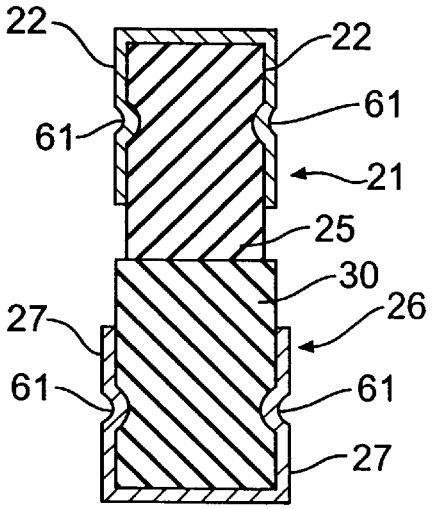
FIG. 8 is a cross-sectional view taken on the line 8—8 of FIG. 7.

In FIG. 7 there is shown the garment bag 10, mount structure 15 and hanger support 20 as shown in FIGS. 5 and 6, the clamp jaws 21 and 26 being shown in the closed or latched position thereof. There are provided indentations 61 in the side walls 22 and 27, there being preferably two linearly spaced indentations 61 in one of the side walls 22 and 27 of hanger support 20. As shown in FIG. 8, indentations 61 may be provided in both of the side walls 22 of upper clamp jaw 21 and lower clamp jaw 26. Hence, there may be one or two indentations 61 in each of the side walls 22 and 27 in order to securely hold the resilient blocks 25 and 30.

There have been provided improved garment bag constructions which enable the lower clamp jaw of the hanger support to be substantially horizontal when in the open position thereof, to prevent accidental dislodgement of garment hangers as may occur by sliding off an inclined lower clamp jaw. This is accomplished, as noted herein above, by a mount structure which mounts the upper clamp jaw of the hanger support in an inclined position relative to the upper wall of the garment bag in which it is located, a limiting pin limiting the movement of the lower clamp jaw when the latching device releases it.

In addition, the construction of the hanger support provides for the accommodation of both large diameter plastic garment hangers and smaller diameter wire garment hangers, permitting the plastic garment hangers to be placed at the rear of the hanger support by the connecting structure which enables both rotational and translational movement of the lower clamp jaw relative to the upper clamp jaw.

Moreover, there has been provided a construction in which the size and durometer of resilient blocks forming a part of the upper and lower clamp jaws enables them to be deformed so as to resilient clamp and securely hold both plastic garment hangers and wire garment hangers when such hangers are indeterminately positioned in the hanger support.

In addition, the ability to accommodate both plastic and wire hangers is enhanced by providing resilient blocks which are deeper and of a specific range of durometers, and which also may be movable and spring urged. In an alternate embodiment, indentations in the side walls of the clamp jaws may be provided to securely hold resilient blocks in place within the clamp jaws.

The claims and specification describe the invention presented, and the terms that are employed in the claims draw their meaning from the use of such terms in the specification. Some terms employed in the prior art may be broader in meaning than specifically employed herein. Whenever there is a question between the broader definition of such term as used in the prior art and the more specific use of the term herein, the more specific meaning is meant.

We claim:

1. A garment bag for holding a garment hanger having a hook, the garment bag comprising:

an upper wall and front and rear walls, a hanger support in said garment bag comprising upper and lower clamp jaws and a structure movably connecting said lower clamp jaw to said upper clamp jaw enabling said lower clamp jaw to be rotated between a clamping position for clamping hanger hooks and a release position in which hanger hooks may be placed in and removed from said hanger support, and means for mounting said upper clamp jaw to said garment bag upper wall with said upper clamp jaw angularly related to said garment bag upper wall and inclined upwardly from adjacent said garment bag rear wall to adjacent said garment bag front wall.

2. The garment bag as claimed in claim 1, said mounting means having a first part attached at the underside of said upper wall of said garment bag, a second part having said upper jaw attached thereto, and a third part between said first and second parts, said third part decreasing in depth from adjacent the rear wall of said garment bag towards the front wall thereof.

3. The garment bag as claimed in claim 1, wherein said structure movably connecting said clamp jaws connects said lower jaw at an angle to said inclined upper jaw in said release position of said clamp jaws.

4. The garment bag as claimed in claim 3, and a limiter for holding said lower clamp jaw substantially horizontal in said release position of said hanger support.

5. The garment bag as claimed in claim 1, said jaws comprising linearly extending channels in facing relationship.

6. The garment bag as claimed in claim 5, and further comprising a resilient block in and extending beyond each said channel towards the other said resilient block.

7. The garment bag as claimed in claim 6, said resilient block being an elastomer material of between approximately 50 and 60 durometer.

8. The garment bag as claimed in claim 6, said channels having side walls, and dimples in at least one side wall of each said channel extending into the resilient block therein to hold said resilient block in said channel.

9. The garment bag as claimed in claim 6, at least one said channel and said resilient block therein being relatively dimensioned to enable said resilient block to move in said channel, and at least one resilient element urging said resilient block transversely out of said channel.

10. The garment bag as claimed in claim 9, wherein both said channels and said resilient blocks therein are so relatively dimensioned, and both said channels have at least one said resilient element therein.

11. The garment bag as claimed in claim 9, wherein said resilient element is a coil spring.

12. The garment bag as claimed in claim 9, wherein a plurality of linearly spaced coil springs are between each said resilient block and each said channel.

13. The garment bag as claimed in claim 1, wherein said connecting structure is adjacent said rear wall of said garment bag and comprises means for enabling said lower clamp jaw to rotate relative to said upper clamp jaw, and to translate transversely thereof.

14. The garment bag as claimed in claim 1, and wherein each of said clamp jaws comprises a channel, said clamp jaws having ears adjacent said garment bag rear wall extending from each said channel towards said other channel, transverse openings through said ears, said connecting structure comprising said ears and a pin through said openings, the openings in the ears of at least one said channel being substantially larger than the transverse dimension of said pin to thereby enable said channels to have relative rotational and transverse translational movement.

15. The garment bag as claimed in claim 14, wherein said last mentioned openings are elongate.

16. The garment bag as claimed in claim 14, and wherein said ears of both said channels have elongate openings therein.

17. The garment bag as claimed in claim 1, said clamp jaws comprising linearly extending channels in facing relationship, a resilient block in each said channel of a durometer of approximately 55, the resilient block in said upper clamp jaw channel having a depth of at least about 23/32 inch and extending below said channel of said upper clamp jaw, the resilient block in said lower clamp jaw channel having a depth at the front thereof of approximately 11/16 inch and at the rear thereof of approximately 9/16 inch.

18. The garment bag as claimed in claim 1, wherein said hanger support comprises a latching device for holding said clamp jaws in said clamping position, said latching device comprising an actuating lever, a link pivoted to said actuating lever, and a front plate connected to said link and located outwardly of said clamp jaws adjacent said garment bag front wall.

19. The garment bag as claimed in claim 18, wherein said link is a wire loop having a transverse portion engaging said upper clamp jaw remote from said lower clamp jaw.

20. A garment bag for holding a garment hanger having a hook, the garment bag comprising:

an upper wall and front and rear walls, a hanger support in and connected to said garment bag comprising upper and lower clamp jaws and a connecting means for movably connecting said clamp jaws enabling said clamp jaws to be placed in a clamping position in which said clamp jaws are substantially parallel for clamping hanger hooks and a release position in which said jaws are angularly related so that hanger hooks may be placed in and removed from said hanger support, said connecting means being adjacent said rear wall of said garment bag and comprising means for enabling said lower clamp jaw to rotate relative to said upper clamp jaw, and to translate substantially only transversely thereof, with an end of each said clamp jaw adjacent said rear wall of said garment bag in said positions thereof.

21. The garment bag as claimed in claim 20, wherein said clamp jaws comprise channels having ears adjacent said garment bag rear wall extending from each said channel towards said other channel, openings through said ears, said enabling means comprising said ears and a pin through said openings, the openings in the ears of at least one said channel being substantially larger than the transverse dimension of said pin to thereby enable said channels to have relative rotational and transverse translational movement.

22. The garment bag as claimed in claim 21, wherein said last mentioned openings are elongate.

23. The garment bag as claimed in claim 21, wherein said ears of both said channels have elongate openings therein.

24. The garment bag as claimed in claim 20, said channels being in facing relationship, a resilient block in each said channel of a durometer of approximately 55, the resilient block in said upper clamp jaw channel having a depth of at least about 23/32 inch and extending below said channel of said upper clamp jaw, the resilient block in said lower clamp jaw channel having a depth at front thereof of approximately 11/16 inch and at the rear thereof of approximately 9/16 inch.

25. The garment bag as claimed in claim 20, said clamp jaws comprising linearly extending channels in facing relationship, a resilient block in and extending beyond each said channel towards the other said resilient block, at least one said channel and said resilient block therein being relatively dimensioned to enable said resilient block to move in said channel, and at least one resilient element urging said resilient block transversely out of said channel.

26. The garment bag as claimed in claim 25, wherein both said channels and resilient blocks are so relatively dimensioned, and both said channels have at least one said resilient element therein.

27. The garment bag as claimed in claim 26, wherein said resilient blocks are of from approximately 50 to approximately 60 durometer.

28. The garment bag as claimed in claim 25, wherein said resilient element is a coil spring.

29. The garment bag as claimed in claim 25, wherein a plurality of linearly spaced coil springs are between said resilient block and said channel.

30. A garment bag for holding a garment hanger having a hook, the garment bag comprising:

an upper wall and front and rear walls, a hanger support in said garment bag comprising upper and lower clamp jaws and a structure movably connecting said clamp jaws enabling said clamp jaws to be placed in a clamping position for clamping hanger hooks and a release position in which hangers may be placed in and removed from said hanger support, said clamp jaws comprising linearly extending channels in facing relationship, a resilient block in and extending beyond each said channel towards the other said resilient block, at least one said channel and said resilient block therein being relatively dimensioned to enable said resilient block to move in said channel, and at least on resilient element urging said resilient block transversely out of said channel, wherein said resilient element is a coil spring.

31. A garment bag for holding a garment hanger having a hook, the garment bag comprising:

an upper wall and front and rear walls, a hanger support in said garment bag comprising upper and lower clamp jaws and a structure movably connecting said clamp jaws enabling said clamp jaws to be placed in a clamping position for clamping hanger hooks and a release position in which hangers may be placed in and removed from said hanger support, said clamp jaws comprising linearly extending channels in facing relationship, a resilient block in and extending beyond each said channel towards the other said resilient block, at least one said channel and said resilient block therein being relatively dimensioned to enable said resilient block to move in said channel, and at least on resilient element urging said resilient block transversely out of said channel, wherein a plurality of linearly spaced coil springs are between said resilient block and said channel.

32. A garment bag for holding a garment hanger having a hook, the garment bag comprising:

an upper wall and front and rear walls, a hanger support in said garment bag comprising upper and lower clamp jaws and a structure movably connecting said clamp jaws enabling said clamp jaws to be placed in a clamping position for clamping hanger hooks and a release position in which hangers may be placed in and removed from said hanger support, said clamp jaws comprising linearly extending channels in facing relationship, a resilient block in each said channel of a durometer of approximately 55, the resilient block in said upper jaw channel having a depth of at least about 23/32 inch and extending below said channel of said upper clamp jaw, the resilient block in said lower clamp jaw having a depth at the front thereof of approximately 11/16 inch and at the rear thereof approximately 9/16 inch, wherein said resilient element is a coil spring.

33. A garment bag for holding a garment hanger having a hook, the garment bag comprising:

an upper wall and front and rear walls, a hanger support in said garment bag comprising upper and lower clamp jaws and a structure movably connecting said clamp jaws enabling said clamp jaws to be placed in a clamping position for clamping hanger hooks and a release position in which hangers may be placed in and removed from said hanger support, said clamp jaws comprising linearly extending channels in facing relationship, a resilient block in each said channel of a durometer of approximately 55, the resilient block in said upper jaw channel having a depth of at least about 23/32 inch and extending below said channel of said upper clamp jaw, the resilient block in said lower clamp jaw having a depth at the front thereof of approximately 11/16 inch and at the rear thereof approximately 9/16 inch, wherein a plurality of linearly spaced coil springs are between said resilient block and said channel.

34. A garment bag for holding a garment hanger having a hook, the garment bag comprising:

an upper wall and front and rear walls, a hanger support in said garment bag comprising upper and lower clamp jaws and a structure movably connecting said lower clamp jaw to said upper clamp jaw enabling said lower clamp jaw to be rotated between a clamping position for clamping hanger hooks and a release position in which hanger hooks may be placed in and removed from said hanger support, and a bracket connected to said upper clamp jaw and to said garment bag upper wall having relatively large depth adjacent said garment bag rear wall and a smaller depth towards the garment bag front wall.

35. The garment bag as claimed in claim 34, wherein said structure movably connecting said lower clamp jaw to said upper clamp jaw connects said lower clamp jaw at an angle to said upper clamp jaw in said release position.

36. The garment bag as claimed in claim 35, and a limiter for holding said lower clamp jaw substantially horizontal in said release position of said hanger support.

37. The garment bag as claimed in claim 34, wherein said connecting structure is adjacent said rear wall of said garment bag and comprises means for enabling said lower clamp jaw to rotate relative to said upper clamp jaw, and to translate transversely thereof.

38. The garment bag as claimed in claim 37, wherein said enabling means includes a pin, at least one of said jaws having a slot therein through which said pin passes.

39. A garment bag for holding a garment hanger having a hook, the garment bag comprising:

an upper wall and front and rear walls, a hanger support in and connected to said garment bag comprising upper and lower clamp jaws, and a connecting structure for connecting said clamp jaws for relative movement comprising openings transversely through said clamp jaws, a connecting pin extending through said openings, and the openings in at least one of said clamp jaw being substantially larger than said pin, whereby, said lower clamp jaw may rotate and move transversely of said upper clamp jaw.

40. The garment bag as claimed in claim 39, wherein at least one of said clamp jaws has ears extending from each said clamp jaw at the rear thereof towards the other said clamp jaw, said opening being in the ears of one said clamp jaw and being elongate.

41. The garment bag as claimed in claim 40, wherein said elongate opening is on an axis generally transverse to the length of the clamp jaw on which it is located.

* * * * *

UNITED STATES PATENT AND TRADEMARK OFFICE

CERTIFICATE OF CORRECTION

PATENT NO. : 5,887,710
DATED : March 30, 1999
INVENTOR(S) : Wallace LONDON et al.

It is certified that error appears in the above-identified patent and that said Letters Patent is hereby corrected as shown below:

Claim 30, line 16, replace "on" with --one--.
Claim 31, line 16, replace "on" with --one--.

Signed and Sealed this
Thirteenth Day of July, 1999

*Attest:*

*Attesting Officer*

Q. TODD DICKINSON

*Acting Commissioner of Patents and Trademarks*